US008961249B2

(12) United States Patent
Stearn

(10) Patent No.: US 8,961,249 B2
(45) Date of Patent: Feb. 24, 2015

(54) GUARD AND METHOD FOR PROTECTING WILDLIFE

(76) Inventor: Frederick Stearn, Somerville, NJ (US)

( * ) Notice: Subject to any disclaimer, the term of this patent is extended or adjusted under 35 U.S.C. 154(b) by 0 days.

(21) Appl. No.: 13/603,548

(22) Filed: Sep. 5, 2012

(65) Prior Publication Data

US 2014/0065903 A1 Mar. 6, 2014

(51) Int. Cl.
*B63H 5/00* (2006.01)
*B63H 5/16* (2006.01)

(52) U.S. Cl.
CPC ..... *B63H 5/165* (2013.01)
USPC ..... 440/71; 440/72; 440/66

(58) Field of Classification Search
USPC ..... 440/71, 72, 66
See application file for complete search history.

(56) References Cited

U.S. PATENT DOCUMENTS 2,136,628 A * 11/1938 Lundell ..... 440/72
2,140,099 A * 12/1938 Wise ..... 440/71
2,470,874 A * 5/1949 Sidney ..... 56/8
2,723,641 A * 11/1955 Taylor ..... 416/247 R
2,894,477 A * 7/1959 Brown ..... 440/71
2,916,010 A * 12/1959 Dimmer ..... 416/247 R
4,057,028 A * 11/1977 Palka ..... 440/71
4,902,255 A * 2/1990 Faunda ..... 440/71
5,066,254 A * 11/1991 Bass et al. ..... 440/72
5,176,550 A * 1/1993 Hooper ..... 440/72
5,501,622 A * 3/1996 Phelan ..... 440/71
5,632,218 A * 5/1997 Vaillancourt et al. ..... 114/219
5,664,977 A * 9/1997 Dinkowitz et al. ..... 440/65
5,759,075 A * 6/1998 Steep et al. ..... 440/72
5,839,929 A * 11/1998 Cousins ..... 440/76
6,475,045 B2 * 11/2002 Schultz et al. ..... 440/71
6,503,110 B2 * 1/2003 Lammli ..... 440/71
6,544,082 B1 * 4/2003 Finerty ..... 440/71
7,854,637 B2 * 12/2010 Schultz et al. ..... 440/67
2014/0065903 A1 * 3/2014 Stearn ..... 440/71

* cited by examiner

*Primary Examiner* — Lars A Olson
*Assistant Examiner* — Jovon Hayes

(57) ABSTRACT

A guard for protecting wildlife is mounted on an outboard motor having a propeller and keel below an anti-ventilation plate. The guard has a spaced pair of bars each with an upper section, a lower section and between them a midsection. The upper sections of the bars can be attached to opposite sides of the anti-ventilation plate in order to position the lower sections below the propeller and keel. The lower sections have a smooth, projection-free streamline for avoiding snagging on sea weed.

14 Claims, 1 Drawing Sheet

GUARD AND METHOD FOR PROTECTING WILDLIFE

BACKGROUND OF THE INVENTION

1. Field of the Invention

The present invention relates to apparatus and methods for protecting wildlife, and in particular, to applying such protection to outboard motors.

2. Description of Related Art

Outboard motors typically have an above-water engine coupled to an underwater propeller through a drive train contained inside a housing. The housing usually has extending on either side a horizontal flange acting as an anti-ventilation plate (also sometimes referred to as an anti-cavitation plate, or simply a cavitation plate). This plate is designed to prevent air from above the plate being sucked into the propeller, which would reduce its efficiency or, in extreme cases, prevent forward propulsion.

Outboard motors will also typically have a vertical keel (also referred to as a fin or skeg). This keel will tend to bias the propeller into alignment with the water flowing past the watercraft and thereby decrease destabilizing forces that might turn the propeller away from a neutral position.

Seaweed and fishing lines represent a serious problem for the propellers of watercraft, including the propellers of outboard motors. Entanglement with the propeller can impede and possibly damage the propeller, as well as its drive train and motor. Even if no damage occurs, this entanglement can cause significant drag that will slow the watercraft and reduce its range of operation.

Marine craft can pose a serious danger to aquatic wildlife. For example, manatees are often injured by the propellers of watercraft. The manatee is particularly susceptible since it spends a good portion of its day grazing in shallow waters. Even if the manatee avoids the propeller blades, the keel or skeg projecting below the propeller can by itself inflict serious injury.

Propeller and keel lacerations inflicted on a manatee can lead to infection, internal injuries, limited mobility and eventually death. A large percentage of the surviving manatee population is scarred from their encounters with the propellers and keels of outboard motors.

See also U.S. Pat. Nos. 2,136,628; 2,140,099; 2,723,641; 2,916,010; 4,057,028; 5,066,254; 5,176,550; 5,501,622; and 5,759,075.

SUMMARY OF THE INVENTION

In accordance with the illustrative embodiments demonstrating features and advantages of the present invention, there is provided a wildlife protective guard for an outboard motor having a propeller and keel. The guard has a spaced pair of bars each with an upper section, a lower section and between them a midsection. The upper sections of the pair of bars are adapted to be attached to opposite sides of the outboard motor above the propeller, in order to position the lower sections below the propeller and keel. The lower sections have a smooth, projection-free streamline for avoiding snagging on seaweed.

In accordance with yet another aspect of the invention, a method is provided for protecting wildlife from an outboard motor having a propeller and keel. The method employs a pair of bars. The method includes the step of attaching an upper section of each of the bars to opposite sides of the outboard motor above the propeller, in order to position a lower section of each of the bars below the propeller and keel.

By employing apparatus and methods of the foregoing type, an improved guard is achieved that will be useful on an outboard motor. A disclosed embodiment employs a pair of bars that are the mirror images of each other. In one embodiment, each of the bars has an upper section that is parallel to a lower section.

The upper section is designed to be bolted onto the anti-ventilation plate located above the propeller of an outboard motor. The underside of the upper section is flattened to facilitate mounting. In the disclosed embodiment the upper section has a distal portion that can be attached with substantially a longitudinal orientation and a proximal section extending forwardly at an oblique angle from the distal section.

In this embodiment the lower section of each bar extends below the propeller and keel. These lower sections are spaced apart, one to the right and one to the left of the propeller. Thus, objects encountering the lower section of the bars will be pushed down and to the side, far enough to avoid a collision with the propeller and keel. Also, the lower sections of the bars will diverge to laterally deflect objects.

The midsections of the bars will extend forward of the propeller and keel and will be curved to deflect objects down and away.

The lower sections of the bars will be smooth and will not have any projections that would tend to ensnare seaweed, fishing lines, etc.

BRIEF DESCRIPTION OF THE DRAWINGS

The above description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Referring to FIGS. 1-4, an outboard motor 10 has a housing 10A extending down to a flange 12, herein referred to as a substantially horizontal, anti-ventilation plate. The structure of housing 10A also extends below plate 12 and supports propeller 14. Keel 16 extends downward from housing 10A and lies in a vertical plane intersecting the axis of propeller 14.

Figure 1B:
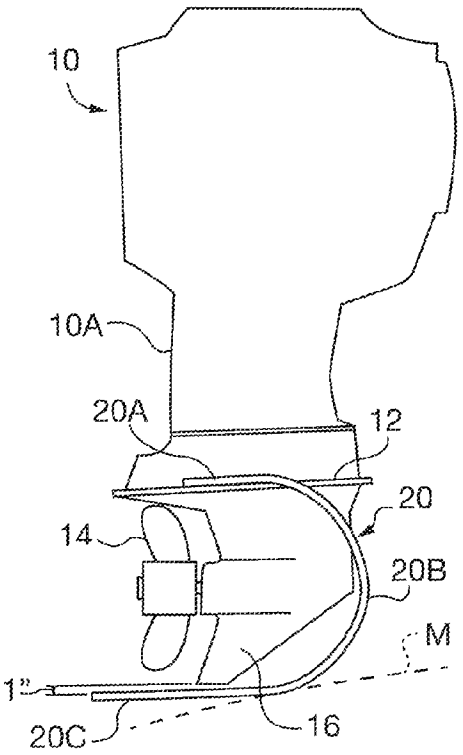
FIG. 1 is a side elevational view of an outboard motor with a guard according to principles of the present invention.

A wildlife protective guard is shown herein as a spaced pair of bars 18 and 20. Bars 18 and 20 are mirror images of each other. Bar 18 has an upper section 18A, a lower section 18C, and between them a midsection 18B. Bar 18 has an upper section 18A, lower section 18C, and between them a midsection 18B. Bar 20 has an upper section 20A, a lower section 20C, and between them a midsection 20B. In this embodiment, bars 18 and 20 are made of stainless steel but in other embodiments different materials can be used, such as chromium steel, various other metals, composite materials, plastic-coated metal rods, etc. As shown in FIG. 1B, there is approximately a 1" gap between the bottom of the keel 16 and the bar 20 in this embodiment.

Figure 2:
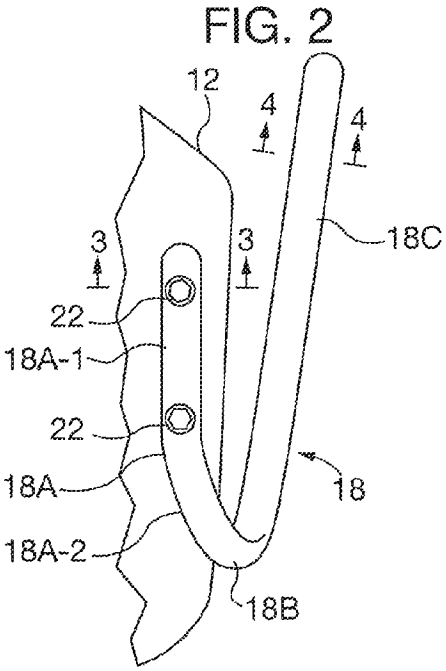
FIG. 2 is top view showing the left portion of the guard and a fragment of the anti-ventilation plate of the outboard motor of FIG. 1.
Figure 3:
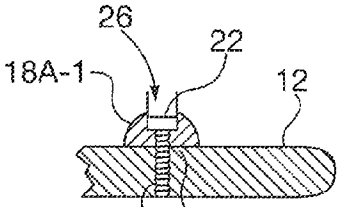
FIG. 3 is a cross-sectional view taken along line 3-3 of FIG. 2.
Figure 4:
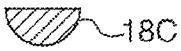
FIG. 4 is a cross-sectional view taken along line 4-4 of FIG. 2.

In FIG. 2, upper section 18A of bar 18 is shown divided into distal portion 18A-1 and proximal portion 18A-2. Distal portion 18A-1 is bolted to plate 12 with bolt 22 having an Allen head. As shown in FIG. 3, bolt 22 is typically screwed into threaded hole 24 in plate 12 and is countersunk in hole 26. Threaded holes 24 may be formed in the factory, or afterwards as an aftermarket retrofit.

As shown in FIG. 3, distal portion 18A-1 has D-shaped cross section, that is, circular except for flat underside 28. This D-shaped cross section is uniform along the lengths of bars 18 and 20. This uniformity provides a smooth, projection-free streamline to avoid snagging on seaweed, fishing lines, etc. The flat underside faces down in sections 18A and 20A, up in sections 18C and 20C, and radially inward in sections 18B and 20B.

Distal portion 18A-1 extends in substantially a longitudinal direction (forward-aft direction). Proximal portion 18A-2 extends forwardly from distal portion 18A-1, diverging outwardly at an oblique angle of approximately 200° (although this angle of divergence may be different depending upon the positioning on plate 12 and the dimensions of plate 12 and bars 18 and 20).

Except for being a mirror image of bar 18, upper section 20A of bar 20 has the same mounting arrangement.

The angle of divergence of each of the lower sections 18C and 20C is approximately 8° from the longitudinal direction (forward-aft direction). It will be appreciated that in some embodiments the angle of divergence of sections 18C and 20C can vary and can be as great as 20° from the longitudinal direction, although in some embodiments lower sections 18C and 20C may be parallel.

Being mounted on plate 12, sections 18A and 20A, for the most part, lie along substantially the same upper plane. In this embodiment, lower sections 18C and 20C, for the most part, lie along substantially a common lower plane, which in this case is substantially parallel to the upper plane of sections 18A and 20A. It will be appreciated that in other embodiments these upper and lower planes need not be parallel and sections 18C and 20C (as well as sections 18A and 20A) need not be coplanar.

It will be noted that lower sections of 18C and 20C are below propeller 14 and keel 16 to push objects down and away from them in order to prevent collisions. In this embodiment sections 18C and 20C are spaced 1 inch (2.5 cm) from keel 16, although this spacing can be different in other embodiments.

In addition, the separation of lower sections 18C and 20C exceeds the overall diameter of propeller 14 to push objects laterally and avoid collisions with the propeller. Also, midsections 18B and 208 are below and forward of keel 16 to push objects away and avoid collisions with the keel.

To facilitate an understanding of the principles associated with the foregoing apparatus, its operation will be briefly described in connection with the embodiment of FIGS. 1-4. Bars 18 and 20 may be installed by first drilling and tapping holes 24 on the right and left and topsides of plate 12. Thereafter, bolt 22 can be inserted through hole 26 and then screwed into threaded holes 24 to secure bars 18 and 20 on plate 12 as shown.

Outboard motor 10 is mounted on a watercraft in the usual fashion. When motor 10 is started, propeller 14 rapidly spins to create forward thrust. Anti-ventilation plate 12 prevents air from being sucked into propeller 14. As the watercraft and outboard motor 10 move forward, keel 16 produces a stabilizing torque to prevent undesired yaw in motor 10.

Should the watercraft encounter seaweed or fishing lines, entanglement is unlikely because bars 18 and 20 have a relatively smooth, projection-free streamline.

Figure 1A:
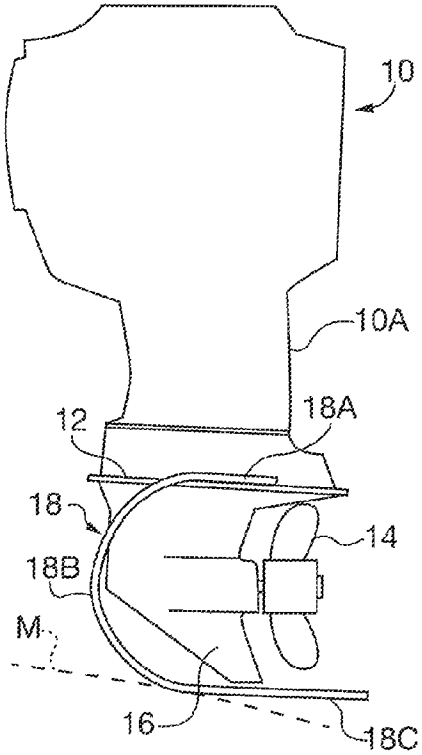

In some unfortunate and unavoidable cases, the watercraft will encounter aquatic wildlife such as a manatee. In FIG. 1, bars 18 and 20 are shown engaging the dorsum of manatee M. The centerlines of midsections 18B and 20B are arcuate and its outside faces are rounded, right to left, and therefore does not present any sharp corners or edges that might impale or lacerate manatee M. Since the dorsum of manatee M is fairly wide, bars 18 and 20 are sufficiently close to prevent the manatee from slipping between them.

Accordingly, manatee M will be deflected away from propeller 14 and keel 16. The deflection will be firm and positive and will not be so impulsive as to be likely to permanently injure manatee M when the watercraft is moving at ordinary, legal speeds.

It is appreciated that various modifications may be implemented with respect to the above described embodiments. In some embodiments the upper portion of the guide bars can be attached to the outboard motor somewhere other than the anti-ventilation flange, e.g., the sides of housing 10A. In addition, the bars may have a sharp bend at the point of departure from the place where they are attached to the outboard motor, with the remainder of the exposed bar having a backwards slant to reduce drag. Also, the attachment may be accomplished with other fastening means such as rivets, welding, etc. Moreover, the guard bars may be tapered in some cases to reduce mass, reduce drag, etc. Moreover, some guard bars may be relatively slender in order to give when encountering an obstruction. In addition, the dimensions, shape and geometry of the guard bars may be altered depending upon the desired strength, reliability, drag, weight, etc.

Obviously, many modifications and variations of the present invention are possible in light of the above teachings. It is therefore to be understood that within the scope of the appended claims, the invention may be practiced otherwise than specifically described.

What is claimed is:

1. A wildlife protective guard for an outboard motor having a propeller and keel, comprising: a horizontally spaced pair of bars each having a generally flat upper section, a generally flat lower section parallel to the upper section and an arcuate midsection connecting the upper section and the lower section, the upper sections of the pair of bars attached to opposite sides of said outboard motor above said propeller and the lower sections below said propeller and keel, said lower section comprising a smooth, projection-free bottom streamlined for avoiding snagging on sea weed.

2. A wildlife protective guard according to claim 1 wherein said upper sections are adapted to be attached to opposite sides of said outboard motor in order to position the lower sections to rearwardly diverge at an acute azimuthal angle with respect to an axis of the propeller.

3. A wildlife protective guard according to claim 1 wherein at least a portion of said upper section has a flat underside.

4. A wildlife protective guard according to claim 3 wherein said lower section diverges at an acute angle from a plane longitudinally aligned with and transverse to at least a portion of said flat underside.

5. A wildlife protective guard according to claim 1 wherein said outboard motor has substantially horizontal anti-ventilation plate, said upper section being adapted to attach to said anti-ventilation plate.

6. A wildlife protective guard according to claim 5 wherein said upper section has a distal portion and a proximal portion extending at an oblique angle from the distal portion.

7. An outboard motor with a wildlife protective guard, comprising: A housing having (a) a propeller, (b) anti-ventilation plate located over the propeller, and (c) a keel extending below the propeller; and a horizontally spaced pair of bars each bar having a generally flat upper section, a generally flat lower section parallel to tile upper section and an arcuate midsection connecting the upper section and lower section, the upper sections of the pair of bars being attached to opposite sides of said anti-ventilation plate and the lower sections below said propeller and keel, said lower section having a smooth, projection-free bottom streamlined for avoiding snagging on sea weed.

8. An outboard motor with a wildlife protective guard according to claim 7 wherein the upper sections of the pair of bars being attached to opposite sides of said anti-ventilation plate in order to position the lower sections to rearwardly diverge at an acute azimuthal angle with respect to an axis of the propeller.

9. An outboard motor with a wildlife protective guard according to claim 7 wherein said midsection of each of said bars is located forward of said upper section and said lower section.

10. An outboard motor with a wildlife protective guard according to claim 7 wherein at least a portion of said upper section lies along an upper plane, and wherein at least a portion of said lower section lies along a lower plane that is parallel to said upper plane.

11. An outboard motor with a wildlife protective guard according to claim 7 wherein at least a portion of said upper section has a flat underside.

12. An outboard motor with a wildlife protective guard according to claim 7 wherein said upper section has a distal section and proximal portion extending at an oblique angle from the distal section.

13. An outboard motor with a wildlife protective guard according to claim 8 wherein said lower section for each of said bars is located to the outside of said propeller.

14. An outboard motor with a wildlife protective guard according to claim 13 wherein said midsection of each of said bars extends forward further than said keel.

* * * * *